US007991341B2

(12) United States Patent
Matsunaka et al.

(10) Patent No.: US 7,991,341 B2
(45) Date of Patent: Aug. 2, 2011

(54) ELECTROPHOTOGRAPHIC FIXING MEMBER AND MANUFACTURING METHOD THEREOF, FIXING APPARATUS, AND ELECTROPHOTOGRAPHIC IMAGE FORMING APPARATUS

(75) Inventors: Katsuhisa Matsunaka, Inagi (JP); Kazuo Kishino, Yokohama (JP); Masaaki Takahashi, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/754,044

(22) Filed: Apr. 5, 2010

(65) Prior Publication Data

US 2010/0189479 A1 Jul. 29, 2010

Related U.S. Application Data

(62) Division of application No. 12/102,134, filed on Apr. 14, 2008, now Pat. No. 7,725,068.

(30) Foreign Application Priority Data

Dec. 7, 2007 (JP) ..... 2007-317279

(51) Int. Cl.
*G03G 15/20* (2006.01)

(52) U.S. Cl. ..... 399/333; 430/124.32; 430/124.33; 430/124.35; 430/124.37; 430/124.38

(58) Field of Classification Search ..... 399/307–308, 399/320, 325, 333, 335; 430/124.32, 124.33, 430/124.34, 124.35, 124.36, 124.37, 124.38
See application file for complete search history.

(56) References Cited

U.S. PATENT DOCUMENTS

| | | | | |
|---|---|---|---|---|
| 4,064,313 | A * | 12/1977 | Takiguchi et al. | 428/447 |
| 5,296,568 | A * | 3/1994 | Chen et al. | 525/431 |
| 5,327,202 | A * | 7/1994 | Nami et al. | 399/333 |
| 5,332,641 | A * | 7/1994 | Finn et al. | 430/124.33 |
| 5,364,697 | A * | 11/1994 | Miyabayashi | 428/323 |
| 5,501,881 | A * | 3/1996 | Fuller et al. | 427/427.5 |
| 5,966,578 | A * | 10/1999 | Soutome et al. | 399/333 |
| 6,020,038 | A | 2/2000 | Chen et al. | |
| 6,678,495 | B1 * | 1/2004 | Badesha et al. | 430/124.33 |
| 6,838,140 | B1 * | 1/2005 | Heeks et al. | 428/36.8 |

(Continued)

FOREIGN PATENT DOCUMENTS

JP 61144675 A * 7/1986

(Continued)

OTHER PUBLICATIONS

English translation of JP 2000-267487.*

(Continued)

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An electrophotographic fixing member is provided, which is excellent in toner releasability and hard to change in rubber elasticity of a silicone rubber elastic layer. The fixing member is laminated with a substrate, a cured silicone rubber layer, a cured silicone rubber adhesive layer and a fluorine resin layer, wherein when infrared light absorption strength ratios (1020 $cm^{-1}$/1260 $cm^{-1}$) at 1020 $cm^{-1}$ and 1260 $cm^{-1}$ determined by sampling the portions of 5 μm and 20 μm from the outer surface of the cured silicone rubber layer are taken as α(5) and α(20), respectively, a relationship of α(5) and α(20) satisfies $$1.03 \leqq \alpha(5)/\alpha(20) \leqq 1.30$$

and α(20) is 0.8 or more and 1.2 or less.

3 Claims, 5 Drawing Sheets

U.S. PATENT DOCUMENTS

| | | | | |
|---|---|---|---|---|
| 7,208,548 | B2 * | 4/2007 | Hakuta et al. | 525/105 |
| 7,268,169 | B2 * | 9/2007 | Hirayma et al. | 521/154 |
| 7,457,577 | B2 * | 11/2008 | Matsunaka et al. | 399/333 |
| 7,615,286 | B2 * | 11/2009 | Kitano et al. | 428/448 |
| 7,699,764 | B2 * | 4/2010 | Ogawa et al. | 492/56 |
| 7,700,171 | B2 * | 4/2010 | Matsunaka et al. | 428/34.1 |
| 2004/0229044 | A1 * | 11/2004 | Goto | 428/421 |
| 2007/0148438 | A1 * | 6/2007 | Pickering et al. | 428/327 |
| 2009/0047048 | A1 * | 2/2009 | Ikeda et al. | 399/333 |
| 2010/0124661 | A1 * | 5/2010 | Moorlag et al. | 428/421 |
| 2010/0124662 | A1 * | 5/2010 | Moorlag et al. | 428/421 |
| 2011/0082260 | A1 * | 4/2011 | Omata et al. | 525/276 |

FOREIGN PATENT DOCUMENTS

| | | |
|---|---|---|
| JP | 2000-75714 | 3/2000 |
| JP | 2000-267487 | 9/2000 |
| JP | 2001-324888 | 11/2001 |
| JP | 2001-435888 | 11/2001 |
| JP | 2003-75714 | 3/2003 |
| JP | 2005-157173 | 6/2005 |
| JP | 2005-238765 | 9/2005 |
| JP | 2005-300591 | 10/2005 |
| JP | 2006-30801 | 2/2006 |

OTHER PUBLICATIONS

International Preliminary Report on Patentability, issued by the International Bureau, in International Application No. PCT/JP2007/074589.

"Selection of Silicon Compound and Optimum Utility Technique", First Edition, Technical Information Institute Co., Ltd., p. 223 (Oct. 31, 2006).

* cited by examiner

ELECTROPHOTOGRAPHIC FIXING MEMBER AND MANUFACTURING METHOD THEREOF, FIXING APPARATUS, AND ELECTROPHOTOGRAPHIC IMAGE FORMING APPARATUS

CROSS-REFERENCE TO RELATED APPLICATIONS

This application is a divisional of U.S. patent application Ser. No. 12/102,134, filed Apr. 14, 2008, now U.S. Pat. No. 7,725,068, issued May 25, 2010.

BACKGROUND OF THE INVENTION

1. Field of the Invention

The present invention relates to a manufacturing method of an electrophotographic fixing member and an electrophotographic fixing member. It also relates to a fixing apparatus and an electrophotographic image forming apparatus using the same.

2. Description of the Related Art

In general, in a heat-fixing apparatus used for electrophotographic system, members of rotation such as a pair of heated rollers and rollers, a film and a roller, and a belt and a roller are press-contacted.

A recording material holding an image by an unfixed toner is introduced into a press-contact region formed between these members of rotations and heated, thereby to melt the toner to fix the image on the recording material.

The member of rotation to which the unfixed toner image held on the recording material contacts is referred to as a fixing member, and according to its form, it is referred to as a fixing roller, a fixing film, and a fixing belt.

These fixing members are known to dispose silicone rubber layers having heat resistance on a substrate formed by metal or heat resisting resin and the like and coat these layers with release layers made of fluorine resin with silicone rubber adhesives. As a silicone rubber composition used for the formation of the silicone rubber layer, an addition curing type silicone rubber is in heave usage in view of workability.

Further, as the silicone rubber adhesive, the one using an addition curing type silicone rubber adhesive is known, which has a self-adhesiveness in a liquid state or a pasty state (Japanese Patent Application Laid Open No. 2005-238765). This is because the addition curing type silicone rubber adhesive adheres the silicone rubber layer with the release layer made of fluorine resin in a good state.

The fixing member having a configuration as described above can enclose and melt the toner image without compressing it excessively because of an excellent elastic deformation of the silicone rubber layer. Hence, this has an effect of preventing an image displacement and bleeding and improving a color mixture. Further, this has an effect of following the unevenness of a fiber of the paper severing as a heated medium and preventing the occurrence of an irregularity of toner melting.

However, when the surface of the cured silicone rubber layer formed by using the addition curing silicone rubber is adhered with a fluorine resin layer serving as the release layer by using the addition curing type silicone rubber adhesive, the following problem has arisen. That is, the component of the silicone rubber adhesive inside the cured silicone rubber layer has infiltrated, and an unsaturated aliphatic group in the cured silicone rubber layer has been often reacted with active hydrogen in the adhesive, thereby inviting the rising in the hardness of the cured silicone rubber layer.

As a result, there are often the cases where the surface hardness of the fixing member rises, thereby diminishing the excellent advantage brought about by the elastic deformation of the silicone rubber layer.

Japanese Patent Application Laid-Open No. 2006-030801 proposes, with a view to solve such a problem, to suppress an amount of the unsaturated aliphatic group remaining in the silicone rubber layer after cross-linking of the silicone rubber layer. By adopting such a configuration, the reaction with the unsaturated aliphatic group in the silicone rubber layer and the active hydrogen in the adhesive can be suppressed. As a result, the rise in hardness of the silicone rubber layer accompanied with the use of the addition curing type silicone adhesive can be effectively suppressed.

SUMMARY OF THE INVENTION

Now, the unsaturated aliphatic group in the rubber plays an extremely important role in alleviating an aging of the rubber. That is, a cross-linked structure borne by the rubber is cut over time, so that the rubber elasticity is gradually reduced. This is known as an aging phenomenon of the rubber. When an unsaturated aliphatic group is present in the rubber, it is known that the unsaturated aliphatic group is reacted and the cross-linked structure is re-built, so that the rubber elasticity is hard to deteriorate. From this, it has an extremely significant implication in the technical point of view to allow the unsaturated aliphatic group to be present in the rubber.

Consequently, though the configuration according to the Japanese Patent Application Laid-Open No. 2006-030801 can be an effective countermeasure for the variation of hardness by usage of the adhesive, it is a disadvantageous configuration for the aging of the silicone rubber layer.

Particularly, for the improvement of heat conductivity, the fixing member is often added with a heat conductive filler on the silicone rubber layer in a considerable amount, for example, not less than 40 cubic volume %. In this case, the amount of the rubber component which is a main expressive constituent of the silicone rubber layer elasticity in the silicone rubber layer is relatively reduced. Hence, when an aging occurs in the rubber component, the reduction of the elasticity of the silicone rubber layer can be more noticeable.

Hence, the present inventors have studied allowing the unsaturated aliphatic group, which can alleviate the aging in some degree, to be present in the silicone rubber layer in the fixing member which is formed by adhering the fluorine resin layer on the silicone rubber layer by using the addition curing type silicone adhesive. As a result, the present inventors have found that the usage of the addition curing type silicone adhesive and the allowing of the unsaturated aliphatic group to be present in the silicone rubber layer are compatible with each other, thereby having carried out the present invention.

An object of the present invention is to provide a fixing member capable of maintaining rubber elasticity more stably and a manufacturing method thereof in the fixing member formed by fixing the fluorine resin layer by using an addition curing silicone adhesive on a silicone rubber layer.

Another object of the present invention is to provide a fixing member and an electrophotographic image forming apparatus to stably furnish an electrophotographic image of high grade.

The present inventors have conducted various researches to achieve the above described objects.

Specifically, a coated film of the silicone rubber composition including the addition curing silicone rubber and filler on the substrate was cured to the extent of maintaining elasticity so as to make it as a silicone rubber layer, and after that, an ultraviolet light was irradiated on the silicone rubber layer surface.

After that, the addition curing type silicone rubber adhesive is directly applied to the surface of the silicone rubber layer, where the ultraviolet light has irradiated, and then fluorine resin tube was adhered with the adhesive. As a result, contrary to the expectation, the rise in the hardness of the silicone rubber layer due to the adhesive was hardly recognized. The present invention was carried out based on such a novel finding.

The silicone rubber layer according to the above experiment has an amount of the cross-linking component (polyorganosiloxane having active hydrogen) relatively blended little, so that the elasticity can be maintained even after the hardening, and therefore, includes a plenty of the unsaturated aliphatic groups. In spite of this, the reason why the rise of the hardness of the silicone rubber layer due to the addition curing type silicone rubber adhesive by the irradiation of the ultraviolet light on the surface is suppressed is not yet sufficiently solved. However, the present inventors speculate as follows.

That is, a cross-linking property of the silicone rubber is improved on the upper most surface of the silicone rubber layer by the irradiation of the ultraviolet light, so that an extremely dense structure is built up. As a result, it is considered that infiltration of the adhesive component (particularly, polyorganosiloxane having active hydrogen) into the silicone rubber layer is suppressed. On the other hand, it is considered that a state in which the cross-linking density is low to the extent of maintaining elasticity of the silicone rubber layer is maintained inside the silicone rubber layer. As a result, it is considered that the above described advantage is afforded.

An electrophotographic fixing member in which a substrate, a cured silicone rubber layer, a cured silicone rubber adhesive layer and a fluorine resin layer are laminated, wherein an infrared light absorption strength ratio $\alpha(5)$ and an infrared light absorption strength ratio $\alpha(20)$ satisfy the relationship represented by the following formula:

$$1.03 \leqq \alpha(5)/\alpha(20) \leqq 1.30$$

where $\alpha(5)$ denotes an infrared light absorption strength ratio at 1020 $cm^{-1}$ and 1260 $cm^{-1}$ (1020 $cm^{-1}$/1260 $cm^{-1}$) of a portion sampled at 5 μm from the outer surface of the cured silicone rubber layer, and $\alpha(20)$ denotes an infrared light absorption strength ratio at 1020 $cm^{-1}$ and 1260 $cm^{-1}$ (1020 $cm^{-1}$/1260 $cm^{-1}$) of a portion sampled at 20 μm from the outer surface of the cured silicone rubber layer, and wherein $\alpha(20)$ is 0.8 or more and 1.2 or less.

An electrophotographic fixing member in which a substrate, a cured silicone rubber layer, a cured silicone rubber adhesive layer and a fluorine resin layer are laminated, wherein a micro hardness $H_{\mu 0}$ and a micro hardness $H_{\mu 1}$ satisfy the following relationship:

$$H_{\mu 1}/H_{\mu 0} \geqq 2.5$$

where $H_{\mu 0}$ denotes a micro hardness of a cured rubber constituting the cured silicone rubber layer, and $H_{\mu 1}$ denotes a micro hardness of a cured rubber obtained by soaking the cured rubber in a methylhydrogen silicone oil for 24 hours, and then cured.

An electrophotographic fixing member in which a substrate, a cured silicone rubber layer comprising a filler in an amount ranging 40 vol. % or more and 60 vol. % or less, a cured silicone rubber adhesive layer, and a fluorine resin layer are laminated in this order, wherein the cured silicone rubber layer has a thickness of 100 μm or more and 500 μm or less, and Type C micro hardness of the surface is 60 degrees or more and 90 degrees or less.

The fixing member according to the present invention includes the electrophotographic fixing member and a heating unit of the electrophotographic fixing member.

Further, the electrophotographic image forming apparatus according to the present invention includes the fixing apparatus and a transfer unit of a transfer medium to the fixing apparatus.

A manufacturing method of an electrophotographic fixing member comprising the steps of:

(1) forming an addition curing type silicone rubber layer on a substrate, (2) curing the addition curing type silicone rubber layer, thereby to form the cured silicone rubber layer;

(3) laminating a fluorine resin layer on the surface of the cured silicone rubber layer with the addition curing type silicone rubber adhesive, and (4) curing the addition curing type silicone rubber adhesive, wherein the method further comprises a step of irradiating the surface of the cured silicone rubber layer with an ultraviolet light prior to the step (3).

According to the electrophotographic fixing member according to the present invention, the following advantages can be obtained.

That is, in the electrophotographic fixing member configured to fix the fluorine resin layer on the silicone rubber layer by the addition curing silicone adhesive, a plenty of unsaturated aliphatic groups are allowed to be present in the silicone rubber layer. Hence, the reduction of elasticity due to the aging of the silicone rubber layer can be suppressed.

Further, since the fluorine resin layer is firmly fixed on the silicone rubber layer by the addition cured adhesive, a good toner releasing property can be secured for a long period.

Further, the rise in hardness due to the usage of the addition curing type silicone rubber adhesive of the silicone rubber layer including the unsaturated aliphatic group can be suppressed. As a result, the electrophotographic fixing member low in hardness of the surface can be obtained.

Further, according to the present invention, a fixing apparatus and an electrophotographic image forming apparatus capable of stably forming a high grade electrophotographic image can be obtained.

DESCRIPTION OF THE EMBODIMENTS

(1) Schematic Configuration of Fixing Member

Details of the present invention will be described by using the drawings.

Figure 4:
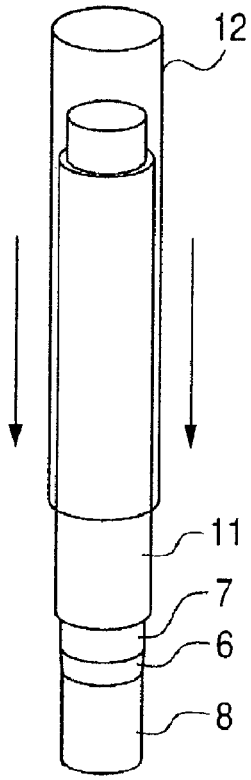
FIG. 4 is a schematic explanatory drawing of the fixing member according to the present invention.
Figure 7:
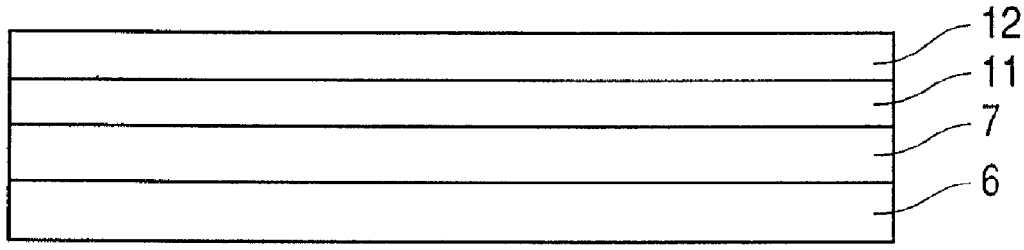
FIG. 7 is a schematic cross sectional view of a portion of the fixing member according to the present invention.

FIG. 4 is a schematic diagram illustrating one aspect of an electrophotographic fixing belt according to the present invention. FIG. 7 is a schematic cross sectional view thereof.

In FIGS. 4 and 7, reference numeral 6 denotes a substrate, reference numeral 7 a cured silicone rubber layer coating the peripheral surface of the substrate 6, and reference numeral 12 a fluorine resin tube. The fluorine resin tube 12 is fixed on the surface periphery of the silicone rubber layer 7 by a cured silicone rubber adhesive layer 11.

(2) Substrate

As the substrate 6, for example, a metal or an alloy such as aluminum, iron, stainless, and nickel, and heat resisting resin such as polyimide are used.

When the fixing member is roller-shaped, a core shaft is used for the substrate 6. As a material of the core shaft, for example, a metal or an alloy such as aluminum, iron, and stainless are used.

When the fixing member has a belt shape, as the substrate 6, for example, a heat-resisting resin belt made of an electroformed nickel belt, polyimide, and the like can be cited.

(3) Silicone Rubber Layer and Manufacturing Method Thereof

A silicone rubber layer 7 functions as an elastic layer allowing the fixing member to bear elasticity so as not to crush the toner at the fixing time.

To manifest such a function, the silicone rubber layer 7 preferably cures the addition curing silicone rubber. This is because the elasticity can be adjusted by adjusting the cross-linking degree according to the type and an additive amount of the filler to be described later.

(3-1) Addition Curing Silicone Rubber

In general, the addition curing silicone rubber includes organopolysiloxane having an unsaturated aliphatic group, organopolysiloxane having active hydrogen bound to silicon, and a platinum compound as a cross-linking catalyst.

An example of organopolysiloxane having an unsaturated aliphatic group includes the following.

Straight-chain organopolysiloxane wherein both molecule terminals are expressed by $R^1{}_2R^2SiO_{1/2}$, and an intermediate unit is expressed by $R^1{}_2SiO$ and $R^1R^2SiO$.

Branched polyorganosiloxane wherein $R^1SiO_{3/2}$ to $SiO_{4/2}$ are included in the intermediate unit.

Here, $R^1$ represents a monovalent non-substituted or substituted hydrocarbon group which does not include the aliphatic unsaturated group bonded to a silicon atom. Specifically, the following is included:

an alkyl group (for example, methyl, ethyl, propyl, butyl, pentyl, hexyl, and the like);

an aryl group (phenyl group); and a substituted hydrocarbon group (for example, chloromethyl, 3-chloropropyl, 3,3,3-trifuluoropropyl, 3-cyanopropyl, 3-methoxypropyl, and the like).

Particularly, since synthesis and handling are easy and excellent heat resistance can be obtained, 50% or more of $R^1$ is preferably a methyl group, and all $R^1$ are particularly preferable to be the methyl group.

Further, $R^2$ represents the unsaturated aliphatic group bonded to a silicon atom, and a vinyl, allyl, 3-butenyl, 4-pentenyl, 5-hexynyl are illustrated, and since synthesis and handling are easy, and a cross-linking reaction can be easily performed, vinyl is preferable.

Further, organopolysiloxane having the active hydrogen bonded to silicon is a cross-linking agent, which forms a cross-linked structure by the reaction with an alkenyl group of an organopolysiloxane component having the unsaturated aliphatic group by a catalytic action of the platinum compound.

The number of hydrogen atoms bonded to the silicon atom is a number exceeding three pieces in average in one molecule.

As an organic group bonded to the silicon atom, a non-substituted or substituted monovalent hydrocarbon group can be illustrated, which is in the same range as $R^1$ of the organopolysiloxane component having the unsaturated aliphatic group. Particularly, since synthesis and handling are easy, a methyl group is preferable.

A monocular weight of organopolysiloxane having active hydrogen bonded to silicon is not particularly limited.

Further, viscosity of organopolysiloxane at 25° C. is preferably in the range of 10 $mm^2/s$ or more and 100,000 $mm^2/s$ or less, and more preferably 15 $mm^2/s$ or more and 1,000 $mm^2/s$ or less. The reason why viscosity of the organopolysiloxane at 25° C. is preferably in the above described range is because it does not happen that a desired cross-linking properties and physical properties of molded articles are not obtained due to evaporation during preservation, and moreover, synthesis and handling are easy so that it can be easily diffused in the system.

A siloxane base can be in the shape of any of a straight-chain, branched or circular, and a mixture of these shapes may be used. Particularly, because of easiness of synthesis, the shape of a straight-chain is preferable. A Si—H binding may be present in whichever silozane unit in the molecule, but at least a part thereof is preferably present in a siloxane unit of the molecule terminal such as a $R^1{}_2HSiO_{1/2}$ unit As the addition curing silicone rubber, an amount of the unsaturated aliphatic group is preferably 0.1 mol % or more and 2.0 mol % or less for silicon atom 1 mol, and particularly, more preferably 0.2 mol % or more and 1.0 mol % or less.

Further, the unsaturated aliphatic groups and active hydrogens are blended in such a ratio that a ratio of the number of active hydrogens to unsaturated aliphatic groups is preferably 0.3 or more and 0.8 or less. The ratio of the number of active hydrogens to unsaturated aliphatic groups can be quantitatively calculated by measurement using Hydrogen Nuclear Magnetic Resonance Analysis (for example, $^1$H-NMR (Model Name: AL400 type FT-NMR made by Nihon Denshi Kabushiki Kaisha). By setting the ratio of the number of active hydrogens to unsaturated aliphatic groups within the above described numerical range, the hardness of the silicone rubber layer after curing can be stabilized. Further, an excessive rise of the hardness can be suppressed.

(3-2) Filler

The silicone rubber layer 7 may include filler for improvement of heat conductivity, reinforcement, and improvement of heat resistance, and the like for the fixing member.

(3-2-1) Material

Particularly, to improve heat conductivity, as the filler, the material is preferably of high heat conductivity. Specifically, an inorganic material, particularly a metal, a metal compound, and the like can be cited.

A specific example of the high heat conductive filler includes the following:

silicon carbide (SiC); silicon nitride ($Si_3N_4$); boron nitride (BN); aluminum nitride (AlN); alumina ($Al_2O_3$); zinc oxide (ZnO); magnesia oxide (MgO); silica ($SiO_2$); copper (Cu); aluminum (Al); silver (Ag); iron (Fe); nickel (Ni), and the like.

These elements can be used individually or by mixing two or more elements. An average particle size of the high heat conductive filler is preferably 1 μm or more and 50 μm or less in view of handling and dispersibility. Further, the shape to be used may be spherical, pulverized, needle, platy, whisker, and the like. However, the spherical shape is preferable in view of dispersibility.

(3-2-2) Content

The filler is preferably included in the silicone rubber layer 7 to achieve its object in the range of 40 vol. % or more and 60 vol. % or less based on the silicone rubber layer.

(3-3) Thickness of Silicone Rubber Layer

From the contribution to the surface hardness of the fixing member and the efficiency of heat conductance to the unfixed toner at the fixing time, a preferable range of the thickness of the silicone rubber layer is preferably in the range of 100 μm or more and 500 μm or less, and particularly preferable in the range of 200 μm or more and 400 μm or less.

(3-4) Manufacturing Method of Silicone Rubber Layer

Figure 1:
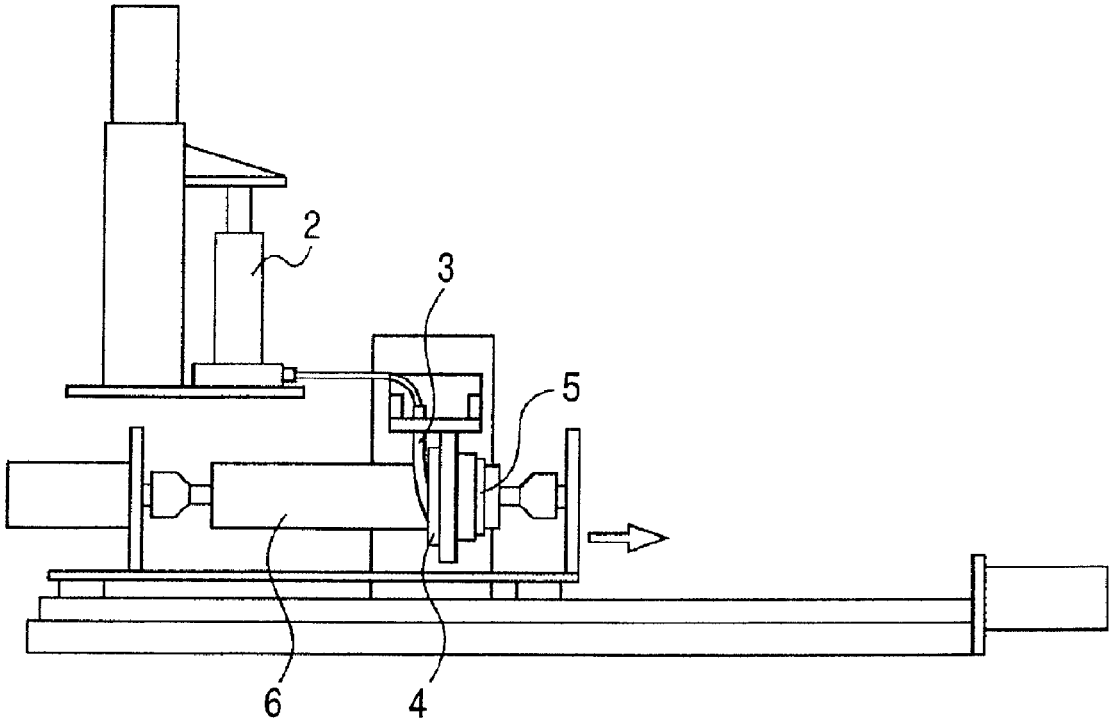
FIG. 1 is a schematic explanatory drawing of a manufacturing method of a fixing member according to the present invention.

FIG. 1 is one example of a process of forming the silicone rubber layer 7 on the substrate 6, and is a schematic illustration for describing the method of using a so-called ring coat method.

The addition curing silicone rubber composition blended with the addition curing silicone rubber and the filler is filled into a cylinder pump 2 for pressure feeding, so that a coating liquid is coated on the periphery of the substrate 6 from a supply nozzle 3.

By moving the substrate 6 together with the coating at the same time in the right direction in the figure at a constant speed, a coating film of the addition curing silicone rubber composition 5 can be formed in the peripheral surface of the substrate 6.

The thickness of the coating film can be controlled by a clearance between the coating liquid supply nozzle 3 and the substrate 6, a supply speed of the silicone rubber composition 5, a moving speed of the substrate 6, and the like. Reference numeral 4 in FIG. 1 denotes a coating head.

The addition curing type silicone rubber layer formed on the substrate 6 is heated for a certain time by a heating unit such as an electric furnace, thereby to expedite a cross-linking reaction, so that it can be made into the cured silicone rubber layer 7.

(4) Ultraviolet Light Irradiation Process

Figure 2:
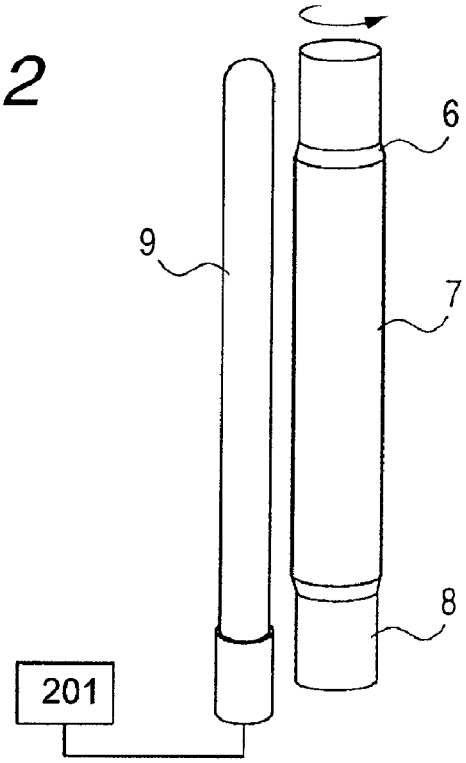
FIG. 2 is an explanatory drawing of an ultraviolet light irradiating process in a manufacturing process of the fixing member according to the present invention.

FIG. 2 is a schematic illustration of one example of a process of irradiating the ultraviolet light on the cured silicone rubber layer 7 of the fixing belt.

A core cylinder 8 is inserted and held in a state in which the cured silicone rubber layer 7 is formed on the substrate 6, and is set so as to be approximately in parallel at a position away approximately 10 mm from an ultraviolet light lamp 9.

The ultraviolet light lamp 9 connected to a power supply 201 is turned on for a certain time in a state in which the core cylinder 8 is rotated at a constant speed by using an unillustrated unit, and the ultraviolet light is irradiated on the cured silicone rubber layer surface. Since the ultraviolet light of particularly short wavelength from among the ultraviolet light rays has a high energy, it is known to activate various bindings. Here, a phenomenon will be described in the case where the irradiation is performed on the cured silicone rubber surface.

The ultraviolet light of the wavelength in the vicinity of 185 nm, which emits a light when using a constant-pressure mercury ultraviolet lamp, gives energy higher than the binding energy of oxygen molecule in the air present in the environment, thereby generating active oxygen.

$$O_2+\text{ultraviolet}(185\ \text{nm})\rightarrow O+O(\text{dissolution of oxygen molecule})$$

The active oxygen is further reacted with the oxygen molecule, thereby generating an ozone molecule in the environment.

$$O+O_2\rightarrow O_3(\text{generation of ozone molecule})$$

This ozone molecule absorbs the ultraviolet light in the vicinity of 254 nm, and is dissolved again into the oxygen molecule and the active oxygen.

$$O_3+\text{ultraviolet light}(254\ \text{nm})\rightarrow O_2+O(\text{dissolution of Ozone molecule})$$

In the process of repeating the generation and the dissolution of ozone molecules in this manner, the active oxygen is generated in the ultraviolet light irradiation environment.

Further, the high energy ultraviolet light is irradiated on the silicone rubber layer surface, so that Si—C binding due to dimethylsiloxane of the silicone rubber layer surface is activated, and is dissociated.

Here, the active oxygen reacts with dimethylsiloxane, so that the Si—O binding is newly generated. This reaction progresses such that a network structure in the vicinity of the silicone rubber surface develops. By allowing the network structure to develop in the vicinity of the surface, the infiltration into the cured silicone rubber layer of the addition curing type silicone rubber adhesive used in the next process can be reduced.

From the above described reason, to obtain the reducing effect to be described later of the infiltration of the addition curing type silicone rubber adhesive into the silicone rubber layer, the irradiation of the ultraviolet light of the wavelength of 185 nm is preferable.

Specifically, the ultraviolet light is preferably irradiated such that the integrated quantity of the ultraviolet light of the wavelength 185 nm becomes 300 mJ/cm$^2$ or more and 1000 mJ/cm$^2$ or less.

Figure 3:
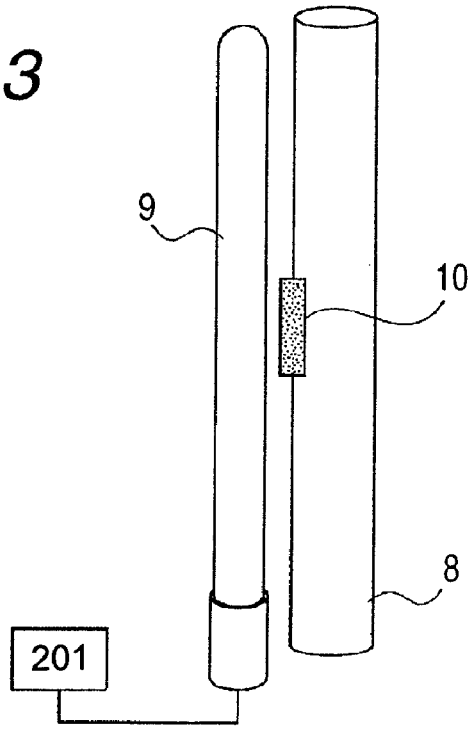
FIG. 3 is an explanatory drawing of a measuring method of an ultraviolet light irradiation amount.

The radiation dose of the ultraviolet light can be measured by a method shown in FIG. 3. The core cylinder 8 is set such that a distance between the surface of an ultraviolet light measuring apparatus 10 (for example, Product name: C8026/H8025-18510; Hamamatsu Photonics K.K.) and an ultraviolet light lamp 9 becomes the same as the silicone rubber layer surface, and the ultraviolet light quantity is measured for a certain irradiation time. As a result, the integrated light quantity per unit area in the silicone rubber layer surface position can be calculated.

(4-1) On Network Structure of Cured Silicone Rubber Layer Surface

Further, a developing degree of the network structure on the cured silicone rubber layer surface can be known by the following method.

When the infrared light is irradiated on the silicone rubber by using an infrared spectrophotometer (FT-IR) and the infrared light absorption equivalent to vibration energy between atoms is measured, absorption due to the Si—C binding is recognized in the vicinity of 1260 cm$^{-1}$ and absorption due to the Si—O binding is recognized in the vicinity of 1020 cm$^{-1}$.

A portion of 5 μm in depth from the outer surface of the silicone rubber layer is sampled by using a parallel removal unit such as a cryo method, and in a state in which the obtained specimen is crushed by a diamond cell, the FT-IR measurement is performed by a microscopic penetration method. For example, by using the FT-IR (Product name: JIR-5500 type FT-IR made by Nippon Denshi Kabushiki Kaisha) and the like, the measurement is performed by setting the number of additions to 100 at a resolution 4 $cm^{-1}$. An infrared light absorption intensity ratio (1020 $cm^{-1}$/1260 $cm^{-1}$) in 1020 $cm^{-1}$ and 1260 $cm^{-1}$ obtained at this time is determined as $\alpha(5)$. Further, the portion of 20 μm in depth from the outer surface of the silicone rubber layer is also subjected to the FT-IR measurement by the same method, and an infrared light absorption intensity ratio $\alpha(20)$ is determined.

At this time, the ultraviolet light is irradiated so that the relationship between $\alpha(5)$ and $\alpha(20)$ preferably satisfies the following formula.

$$1.03 \leqq \alpha(5)/\alpha(20) \leqq 1.30$$

Although the silicone rubber layer in which $\alpha(5)/\alpha(20)$ is in the above described numerical range has a cross-linked structure of the surface densely developed to the extent of sufficiently suppressing the infiltration of the addition curing type silicone rubber adhesive into the cured silicone rubber layer, it can suppress an excessive rise of the hardness as the silicone rubber layer.

The value of $\alpha(20)$ varies according to the ratio of the Si—C binding and the Si—O binding in the base polymer of the silicone rubber layer, and the value of $\alpha(20)$ becomes large when its branching degree by the Si—O binding becomes large and the average molecule amount becomes small. On the contrary, when the branching degree by the Si—O binding becomes small and the average molecule amount becomes large, the value of $\alpha(20)$ becomes small.

In consideration of the self-retainability of the shape of the silicone rubber layer shape and elasticity of the fixing member, the value of $\alpha(20)$ is preferably 0.8 or more and 1.2 or less.

Consequently, the curing of the silicone rubber composition performed prior to the ultraviolet light irradiation preferably uses a composition in which $\alpha(20)$ of the silicone rubber layer obtained by the curing comes within the above described value.

(4-2) On Degree of Presence of Unsaturated Aliphatic Group in Cured Silicone Rubber Layer;

As described above, by the surface treatment of the cured silicone rubber layer, the infiltration into the cured silicone rubber layer of the component of the addition curing silicone adhesive applied to the surface of the cured silicone rubber layer is obstructed. As a result, the unsaturated aliphatic group in the cured silicone rubber layer is not reacted with the component of the addition curing silicone adhesive, and is present in the cured silicone rubber layer. There is no technique available at the present which directly quantitatively determines the amount of the unsaturated aliphatic group in the cured silicone rubber layer after adhered with the addition curing silicone adhesive and using the same. However, the following method allows the amount to be indirectly quantitatively determined.

First, from the fixing member, a plurality of thin specimens of the cured rubber of a predetermined size (for example, 20 mm×20 mm) is cut out from the cured silicone rubber layer, and is laminated to be 2 mm in thickness. On this laminated member, Type C micro hardness is measured with a micro durometer (Product name: MD-1 capa Type C; made by KOBUNSHI KEIKI CO., LTD.). The measured value at this time is taken as $H_{\mu O}$.

Subsequently, all the thin specimens of the cured rubber forming the laminated member are totally soaked into methylhydrogen silicone oil (Product name: DOW CORNING TORAY SH1107FLUID; made by Toray Dow Corning Co. Ltd.) The methylhydrogen silicone oil is maintained at the temperature of 30° C., and is kept still standing for 24 hours. As a result, the methylhydrogen silicone oil is allowed to be infiltrated into the inside of each specimen. Subsequently, all the thin specimens are taken out from the methylhydrogen silicone oil, and the oil on the surface is sufficiently removed, and the specimens are heated in an oven set to 200° C. for four hours, and after that, are cooled to the room temperature. As a result, an addition reaction with the unsaturated aliphatic group and the methylhydrogen silicone oil is completed on all the thin specimens. Next, all the thin specimens are laminated, and the micro hardness of the obtained laminated member is measured by using the above described apparatus. The micro hardness at this time is taken as $H_{\mu 1}$, and a rising ratio of the hardness ($=H_{\mu 1}/H_{\mu O}$) is calculated.

When the amount of the unsaturated aliphatic group in the silicone rubber layer is large, a new cross-linked point is formed in a test specimen by the methylhydrogen silicone oil infiltrated into the test specimen. Hence, the test specimen after the heat treatment shows a sharp rise of the hardness. That is, a rising ratio of the hardness shows a relatively high value.

On the other hand, when the amount of the unsaturated aliphatic group in the silicone rubber layer is small, the test specimen is infiltrated with the methylhydrogen silicone oil, and even when the heat treatment is given, a new cross-linked point is hard to be formed. Hence, hardness variation of the test specimen after the heat treatment is negligible. That is, a rising ratio of the hardness shows a relatively small value.

An experiment for calculating a rising ratio of the hardness is not limited to the above described condition if the unsaturated aliphatic group in the test specimen can be surely reacted.

In the present invention, the rising ratio of the hardness is preferably 2.5 or more and particularly 3.0 or more. The reason why the rising ratio of the hardness is preferably within the above described ratio is because the unsaturated aliphatic group is present relatively abundant in the cured silicone rubber layer and a lowering of rubber elasticity due to the aging can be effectively suppressed.

Further, in view of the stability of the cross-linked structure of the cured silicone rubber layer, the rising ratio of the hardness is preferably 5.0 or less and particularly 4.5 or less.

A specific control of the rising rate of the hardness can be specifically made by the following a) or a combination of the followings a) and b).

Adjustment of Composition of Addition curing silicone rubber Concentrate Solution used for Formation of Cured silicone Rubber Layer.

More specifically, adjustment of the mixed ratio of vinylationpolydimethylsiloxane having two or more vinyl groups in one molecule and hydrogenorganopolysiloxane having two or more Si—H bindings in one molecule in the addition curing silicone rubber concentrate solution.

b) Degree of Ultraviolet Light Treatment of the Cured Silicone Rubber Layer Surface.

As a result, an amount of the infiltration into the cured silicone rubber layer of the addition curing type silicone rubber adhesive applied to the cured silicone rubber layer surface can be changed. That is, the reaction amount with the addition curing type silicone rubber adhesive of the unsaturated aliphatic group in the cured silicone rubber layer can be changed.

(5) Laminating Process of Fluorine Resin Layer on Silicone Rubber Layer Through Adhesive Layer (5-1) Cured Silicone Rubber Adhesive Layer A cured silicone rubber adhesive layer 11 fixed with a fluorine resin tube on the cured silicone rubber layer is made of the hardened material of the addition curing type silicone rubber adhesive coated on the surface of a cured silicone rubber layer 7 irradiated with the ultraviolet light. The addition curing type silicone rubber adhesive includes an addition curing silicone rubber blended with a self-adhesive component.

Specifically, the addition curing type silicone rubber adhesive includes organopolysiloxane having an unsaturated hydrocarbon group represented by a vinyl group, hydrogenorganopolysiloxane, and a platinum compound as a cross-linking catalyst, and is hardened by an addition reaction. As such an adhesive, the known adhesive can be used.

An example of the self-adhesive component includes the following.

Silane having a functional group of at least one or preferably two or more kinds selected from the group consisting of an alkenyl group such as a vinyl group, a (meta) acryloxy group, a hydroxyl group (SiH group), an epoxy group, an alkoxysilyl group, a carbonyl group, and a phenyl group.

An organic silicon compound such as a circular or straight-chain like siloxane of 2 or more and 30 or less, and preferably 4 or more and 20 or less in the number of silicon atoms.

Non-silicon based (that is, having no silicon atom in the molecule) organic compound, which may include an oxygen atom in one molecule, including an aromatic ring of monovalent or higher and tetravalent or lower, preferably divalent or higher and tetravalent or lower such as a phenylene structure and the like not less than one and not more than four and preferably not less than one and not more than two in one molecule, and including a functional group (for example, an alkenyl group and a (meta) arcryloxy group) contributable to a hydrosilylation addition reaction at least one and preferably not less than two and not more than four in one molecule.

The self-adhesive component can be used by one kind independently or by the combination of two or more kinds.

In the adhesive, in view of securing viscosity adjustment and heat resistance, a filler component can be added within the range according to the spirit of the present invention.

The example of the filler component includes the following.

Silica, alumina, iron oxide, cerium oxide, cerium hydroxide, and the like.

Such addition curing type silicone rubber adhesive is available in the market, and can be easily obtained.

(5-2) Fluorine Resin Layer

As the fluorine resin layer, for example, the one forming the resin as illustrated and enumerated below into a tube shape can be used.

Tetrafluoroethylene-perfluoro (allylvinylether) copolymer (PFA), Polytetrafluoroethylene (PTFE), Tetrafluoroethylene-hexafluoropropylene copolymer (FEP) and the like.

From among the materials illustrated and enumerated as above, the PFA is preferable in view of formability and toner releasability.

The thickness of the fluorine resin layer is preferably not more than 50 μm. This is because, when laminated, elasticity of the lower silicone rubber layer can be maintained, and a surface hardness as the fixing member can be prevented from becoming too high.

The inner surface of the fluorine resin tube is given in advance a sodium treatment, an excimer laser treatment, an ammonia treatment, and the like, so that the adhesiveness can be improved.

FIG. 4 is a schematic illustration of one example of the process of laminating the fluorine resin layer on the silicone rubber layer 7 through the addition curing type silicone rubber adhesive.

On the surface of the silicone rubber layer 7 irradiated with the ultraviolet light, the addition curing type silicone rubber adhesive 11 is coated.

On this outer surface, the fluorine resin tube 12 as a fluorine resin layer is coated and laminated.

Although the coating method is not particularly limited, a method of covering the addition curing type silicone rubber adhesive as an antifriction and a method of expanding the fluorine resin tube from the outside and covering the same, and the like can be used.

The surplus addition curing type silicone rubber adhesive remained between the cured silicone rubber layer and the fluorine resin layer is removed by pulling out by using an unillustrated unit. The thickness of the adhesive layer after pulled out is preferably not more than 20 μm.

Next, by heating by a heating unit such as an electric furnace and the like for a predetermined period of time, the addition curing type silicone rubber adhesive is hardened and adhered, and both end portions are cut at a predetermined length, so that the fixing belt as the fixing member of the present invention can be obtained.

(6) Micro Hardness of Fixing Member Surface

The Type C micro hardness of the fixing member surface can be measured by using a micro durometer (Product name: MD-1 capa Type C, made by KOBUNSHI KEIKI CO., LTD.). The micro hardness here is preferably 60 degrees or more and 90 degrees or less, and particularly 70 degrees or more and 85 degrees or less.

By setting the Type C micro hardness within the range of the above described values, the unfixed toner on the transfer medium can be prevented from being excessively crushed, and as a result, a high grade electrophotographic image can be obtained with little image displacement and bleeding.

(7) Fixing Apparatus

Figure 5:
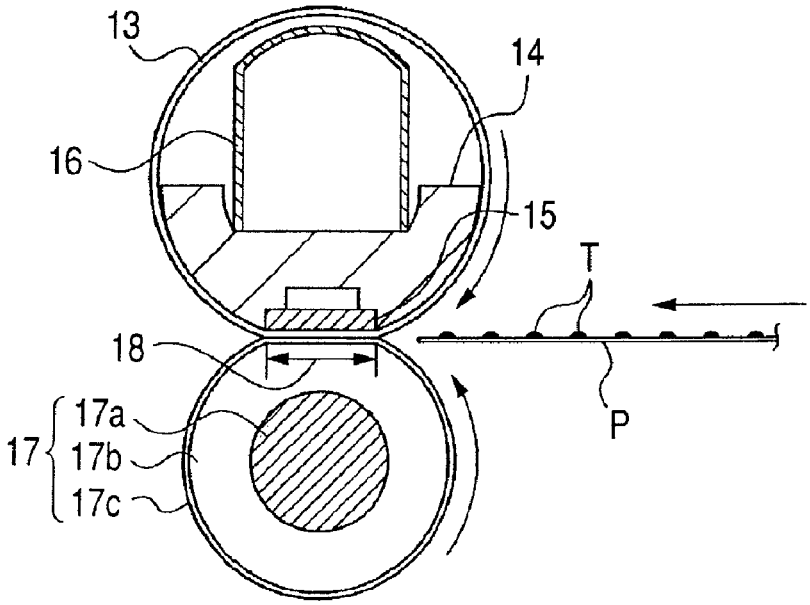
FIG. 5 is a schematic diagram of the fixing member according to the present invention.

FIG. 5 illustrates a sectional schematic illustration in the lateral direction of a heat fixing apparatus using the electrophotographic fixing member having a belt shape according to the present invention.

In this heat fixing apparatus, reference numeral 13 denotes a fixing belt having a seamless shape as the heat fixing member which is one embodiment of the present invention. To hold this fixing belt 13, a belt guide member 14 molded by a heat resisting/heat insulating resin is formed.

A ceramic heater 15 as a heat source is provided at a position at which the inner surfaces of this belt guide member 14 and the fixing belt 13 are brought into contact with each other.

The ceramic heater 15 is fixed and supported by being fitted into a groove portion molded and provided along a longitudinal direction of the belt guide member 14. The ceramic heater 15 is energized and heated by an unillustrated unit.

The fixing belt 13 having the seamless shape is loosely fitted outside the belt guide member 14. A pressure rigid stay 16 is inserted inside the belt guide 14.

An elastic pressure roller 17 as a pressure member reduces a surface hardness by providing an elastic layer 17*b* of the silicone rubber on a stainless core shaft 17*a*.

Both end portions of the core shaft 17*a* are rotatably disposed by being retained by a bearing between an unillustrated near side and the chassis side plate of the back side.

The elastic pressure roller 17 is covered with the fluorine resin tube of 50 μm as a surface layer 17*c* for improving surface nature and releasability.

Between both end portions of the pressure rigid stay 16 and a spring bearing portion (not shown) of the apparatus chassis side, a pressure spring (not shown) is provided in compression, respectively, so that the pressure rigid stay 16 is given a pushing down force.

By this force, the bottom of the ceramic heater 15 disposed at the bottom of the belt guide member 14 and the upper surface of the pressure member 17 are compressed by nipping the fixing belt 13, so that the predetermined fixing nip portion 18 is formed.

A recording material P serving as a heated member formed with an image by an unfixed toner T on this fixing nip portion 18 is nipped and transferred. In this manner, the toner image is heated and pressured. As a result, the toner image is melt, and is mixed with colors, and after that, is cooled, so that the toner image is fixed on the recording medium.

(8) Electrophotographic Image Forming Apparatus

Figure 6:
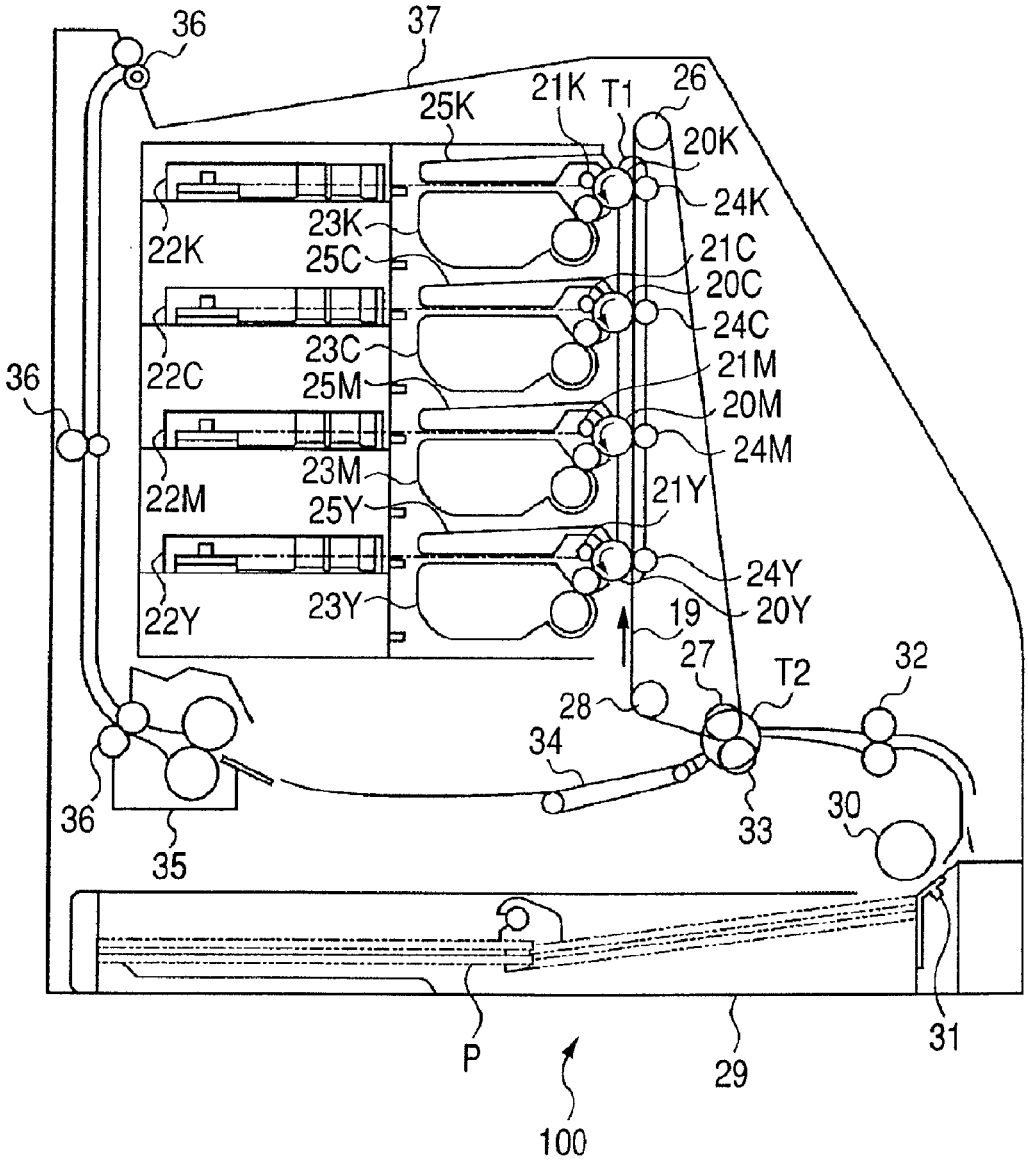
FIG. 6 is a schematic cross sectional view of an electrophotographic image forming apparatus according to the present invention.

A whole configuration of the electrophotographic image forming apparatus will be approximately described. FIG. 6 is a schematic cross sectional view of a color laser printer according to the present embodiment.

A color laser printer (hereinafter, referred to as "printer") 100 illustrated in FIG. 6 includes an image forming portion having an electrophotographic photosensitive drum (hereinafter, referred to as "photosensitive drum") rotating at a constant speed each color of yellow (Y), magenta (M), Cyan (C), and Black (K). Further, an intermediate transfer member 19 retaining a color image developed and multi-transferred at the image forming portion and further transferring the image on the recording medium P fed from a feeding portion is provided.

Photosensitive drums 20 (20Y, 20M, 20C, and 20K) are rotationally driven counter-clock wise as illustrated in FIG. 6 by a drive unit (not shown).

Located around the photosensitive drum 20 are, in order according to the rotating direction, a charging apparatus 21 (21Y, 21M, 21C, and 21K) for uniformly charging the surface of the photosensitive drum 20, a scanner unit 22 (22Y, 22M, 22C and 22K) for irradiating a laser beam based on image information and forming an electrostatic latent image on a photosensitive drum 1, a developing unit 23 (23Y, 23M, 23C, and 23K) for adhering a toner to the electrostatic latent image and developing it as a toner image, a primary transferring roller 24 (24Y, 24M, 24C, and 24K) for transferring the toner image on the photosensitive drum 20 to an intermediate transfer member 19 by a primary transferring portion T1, and unit 25 (25Y, 25M, 25C, and 25K) having a cleaning blade for removing a transfer residual toner remained on the surface of the photosensitive drum 20 after transferring.

When forming an image, the belt shaped intermediate transfer member 19 spanned across the rollers 26, 27, and 28 is rotated, and at the same time, each color toner image formed on each photosensitive drum is superposed on the intermediate transfer member 19 and primarily transferred, thereby to form a color image.

The recording medium is conveyed to a secondary transfer portion by a conveying unit so as to synchronize with the primary transfer on the intermediate transfer member 19. The conveying unit includes a feed cassette 29 storing a plurality of recording mediums P, a feed roller 30, a separating pad 31, and a pair of resist rollers 32. At the image forming time, the feed roller 30 is rotatably driven according to the image forming operation, and the recording mediums P inside the feed cassette 29 are separated one by one, and are conveyed to the secondary transfer portion in timing with the image forming operation by the pair of resist rollers 32.

The secondary transfer portion T2 is disposed with a movable secondary transfer roller 33. The secondary transfer roller 33 is movable approximately up and down. At the image transferring time, the roller is pressed to the intermediate transfer member 19 by a predetermined pressure through the recording medium P. At this time, the secondary transfer roller 33 is simultaneously applied with a bias, and the toner image on the intermediate transfer member 19 is transferred to the recording medium P.

Since the intermediate transfer member 19 and the secondary transfer roller 33 are driven, respectively, the recording medium P in a state nipped by both of them is conveyed in the left direction illustrated in FIG. 6 at a predetermined speed, and is further conveyed to a fixing portion 35, which is the next process, by a conveying belt 34. At the fixing portion 35, the recording medium is applied with heat and pressure so as to be fixed with a transfer toner image. The recording medium is discharged on a discharge tray 37 on the upper surface of the apparatus by a pair of discharger rollers 36.

By applying the fixing apparatus according to the present invention as illustrated in FIG. 5 to the fixing portion 35 of the electrophotographic image forming apparatus as illustrated in FIG. 6, an electrophotographic image forming apparatus capable of providing a high grade electrophotographic image can be obtained, while suppressing energy consumption.

EXAMPLES

Hereinafter, the present invention will be more specifically described by using examples.

Example 1

The following materials (a) and (b) were blended such that a ratio of the number of vinyl groups to Si—H groups (H/Vi) is 0.45, and by adding a platinum compound of a catalyst amount, an addition curing silicone rubber concentrate solution was obtained.

Vinylationpolydimethylsiloxane (weight average molecular weight 100000 (polystyrene conversion) having at least not less than two vinyl groups in one molecule.

Hydrogenpolyorganosiloxane (weight average molecular weight 1500 (polystyrene conversion) having at least not less than two Si—H bindings in one molecule.

A high purity fine spherical alumina (Product name: Alunabeads/CB-A10S, made by Showa Titanium Co. Ltd.) was blended and kneaded as a filler with this addition curing silicone rubber concentrate solution such that its volume ratio becomes 45% based on the cured silicone rubber layer. A silicone rubber composition was obtained in which the durometer hardness in compliance with JIS K6253A is 10 degree after curing.

As a substrate, an electroformed nickel endless belt with a primer treatment given on the surface and having an inner diameter of 30 mm, a width of 400 mm, and a thickness of 40 μm was prepared. In a series of the manufacturing processes, the endless belt was handled by inserting the core shaft 8 as illustrated in FIG. 4 into its interior.

On this substrate, the silicone rubber composition was coated with a thickness of 300 μm by a ring coat method. The obtained endless belt was heated inside the electric furnace set at 200° C. for four hours, thereby hardening the silicone rubber so as to obtain a silicone rubber layer.

While rotating the obtained endless belt in a peripheral direction with a mobile speed of 20 mm/sec in the surface, an ultraviolet light was irradiated by using an ultraviolet lamp disposed at a distance of 10 mm from the surface of the silicone rubber layer. As the ultraviolet light lamp, a low pressure mercury ultraviolet lamp (Product name: GLQ500US/11; made by Harrison Toshiba Lighting Co. Ltd.) was used.

The ultraviolet light was irradiated toward the silicone rubber layer in the atmosphere so that the irradiating condition is set such that the integrated quantity of light of the wavelength of 185 nm is 150 mJ/cm$^2$.

The silicone rubbers located at positions of 5 μm and 20 μm in depth from the surface of the silicone rubber layer after the irradiation of the ultraviolet light were sampled by using the cryo method, and by using the FT-IR, the FT-IR measurement was performed by setting a resolution to 4 cm$^{-1}$ and the number of additions to 100. For the FT-IR measurement, the product name: JIR-5500 type FT-IR: made by Nippon Denshi Kabushiki Kaisha was used.

When the measurement is to be made from a product state, the thicknesses of the fluorine resin layer and the adhesive layer are measured upon cutting the fixing member once in the cross sectional direction. After cutting a total thickness portion from the surface of the fixing member by the cryo method, the positions of 5 μm and 20 μm in depth from the surface are carved out and sampled again by the cryo method, so that the same measurement can be performed.

The values ($\alpha(5)$ and $\alpha(20)$) and the ratio thereof of the infrared absorption strength ratios (1020 cm$^{-1}$/1260 cm$^{-1}$) in 1020 cm$^{-1}$ and 1260 cm$^{-1}$ at the depths 5 μm and 20 μm from the surface of the silicone rubber layer obtained by this measurement are shown in the following Table 1.

(2) By the same method of (1), the endless belt having the silicone rubber layer irradiated with the ultraviolet light on the surface was adjusted.

The surface of the silicone rubber layer of the endless belt was coated with an addition curing type silicone rubber adhesive (Product name: SE1819CV, made by Toray Dow Corning Co. Ltd. (liquid A and liquid B are mixed in equal amount)) so that the thickness becomes approximately 50 μm.

Subsequently, a fluorine resin tube (Product name: KURANFLON-LT; made by Kurabo Industries Ltd.) of 29 mm in inner diameter and 30 μm in thickness was laminated.

The endless belt was heated inside the electric furnace set at 200° C. for one hour, thereby hardening the adhesive so as to fix the fluorine resin tube on the silicone rubber layer. Both end portions of the obtained endless belt were cut, and a fixing belt of 341 mm in width was obtained.

The surface hardness of the obtained fixing belt was measured by using the Type C micro durometer (Product name: MD-1 capa Type C, made by KOBUNSHI KEIKI CO., LTD.). As a result, probably because of the slight suppression of the infiltration of the addition curing type silicone rubber adhesive into the cured silicone rubber layer, the surface hardness indicated 86 degrees.

This fixing belt was installed in a color laser printer (Product name: Satera LBP5900, made by Cannon Inc.), thereby forming an electrophotographic image. Estimation on gloss unevenness of the obtained electrophotographic image was conducted. Gloss unevenness of the electrophotographic image is deteriorated in proportion as the surface hardness of the fixing belt increases. That is, this can be a reference mark showing the magnitude of the effect given to the quality of the electrophotographic image by the surface hardness of the fixing belt.

The estimating image was formed by a print paper of A4 size (Product name: PB PAPER GF-500 made by Cannon Inc., 68 g/m$^2$) with a Cyan toner and a Magenta toner in the total surface at 100% density. This was taken as an estimating image, and by visual observation, estimation on gloss unevenness was made by the following three stages. As a result, estimation B was given to gloss unevenness.

<Estimation Basis>

A: Having almost no gloss unevenness, it was an extremely high grade electrophotographic image.

B: Having few gloss unevenness, it was practically a trouble free electrophotographic image.

C: It was an electrophotographic image having very conspicuous gloss unevenness.

Further, the fixing belt after the gloss unevenness test was put into the electric furnace set at 230° C., and heating was continued for 300 hours to conduct a heat run test, and after that, when the surface hardness of the fixing belt was measured by the Type C micro durometer, a hardness change of +1 degree as compared with the initial stage was indicated.

(3) By using the same method as described in (2), the fixing belt was prepared. The boundary face with the substrate of the obtained fixing belt and the cured silicone rubber layer and the boundary face with the adhesive layer and the cured silicone rubber layer were cut off by a razor blade, and from the fixing belt, the electroformed nickel endless belt, the adhesive layer, and the fluorine resin tube were removed. The thickness of the obtained cured silicone rubber having an endless belt shape was approximately 270 μm. From this cured silicone rubber, a plurality of rubber specimens of 20 mm square was carved out.

Subsequently, the rubber specimens were laminated so as to become 2 mm in thickness, and the micro hardness ($H_{\mu O}$) of the laminated member was measured by using the Type C micro durometer (Product name: MD-1 capa Type C, made by KOBUNSHI KEIKI CO., LTD.). The measured value was 23.1 degrees.

A beaker fed with 50 mL of a methylhydrogen silicone oil (Product name: DOW CORNING TORAY SH1107 FLUID; made by Toray Dow Corning Co. Ltd) was prepared. All the rubber specimens forming the laminated member were fed into the beaker such that the whole of each rubber specimen was immersed so as to be infiltrated. By using a water bath set to the temperature of 30° C., the oil inside the beaker was maintained at the temperature of 30° C., and was kept still standing for 24 hours. After that, the rubber specimens were taken out from the methylhydrogen silicone oil, and the oil on the surface of each rubber specimen was sufficiently wiped out by a wiper (Product name: kimwipe S-200; made by Nippon Paper Cresia Co. Ltd). Each rubber specimen was put into an oven set at 200° C., and was heated for four hours, and after that, it was cooled up to the room temperature. Each rubber specimen was taken out from the oven, and was laminated again, and similarly as before, the micro hardness ($H_{\mu 1}$) of the laminated member was measured. The measured value indicated 62.4 degrees.

Hence, a rising ratio (aminated again, and similarly as before, the rising ratio ($H_{\mu 1}/H_{\mu O}$) of the hardness of the cured silicone rubber layer of the fixing belt according to the first example became 2.7.

Example 2 to Example 11 and Comparative Example 1 to Comparative Example 7

A ratio (H/Vi) of the number of vinyl groups to Si—H groups in the silicone rubber composition, the thickness of the coating of the silicone rubber composition, a type and an amount of fillers, and the ultraviolet irradiation condition were changed as described in Table 1. Otherwise, similarly to the first example, the endless belt and the fixing belt were adjusted, and estimated. Each value of α(5) and α(20) of each obtained silicone rubber layer, the value of α(5)/α(20), the surface hardness of each fixing belt, the variation of the surface hardness after the heat run test, the rising ratio of the hardness of the cured silicone rubber layer, and the estimation result of the electrophotographic image obtained by using each fixing belt are shown in Table 2.

In Examples 7 to 11 and Comparative Examples 5 to 7, the following filler was used, respectively.

Example 7: high purity fine spherical alumina (Product name: Alunabeads/CB-A20S, made by Showa Titanium Co. Ltd.)

Example 8 and Comparative Example 5: high purity fine spherical alumina (Product name: Alunabeads/CB-A30S, made by Showa Titanium Co. Ltd.)

Example 9 and Comparative Example 6: high purity fine spherical alumina (Product name: Alunabeads/CB-A05S, made by Showa Titanium Co. Ltd.)

Examples 10 to 11, and Comparative Example 7 high purity fine spherical alumina (Product name: Alunabeads/CB-A25BC, made by Showa Titanium Co. Ltd.)

TABLE 1

| | Thickness of cured silicone rubber layer (μm) | H/Vi | Filler amount (vol. %) | Integrated quantity of ultraviolet light (mJ/cm$^2$) | α(5) | α(20) | α(5)/α(20) |
|---|---|---|---|---|---|---|---|
| Example 1 | 300 | 0.45 | 45 | 150 | 1.07 | 1.05 | 1.02 |
| Example 2 | 300 | 0.45 | 45 | 300 | 1.08 | 1.05 | 1.03 |
| Example 3 | 300 | 0.45 | 45 | 500 | 1.12 | 1.05 | 1.07 |
| Example 4 | 300 | 0.45 | 45 | 800 | 1.20 | 1.05 | 1.14 |
| Example 5 | 300 | 0.45 | 45 | 1000 | 1.36 | 1.05 | 1.30 |
| Example 6 | 300 | 0.45 | 45 | 2000 | 1.63 | 1.07 | 1.52 |
| Comparative Example 1 | 300 | 0.45 | 45 | — | 1.05 | 1.05 | 1.00 |
| Comparative Example 2 | 300 | 1.20 | 45 | — | 1.05 | 1.05 | 1.00 |
| Comparative Example 3 | 300 | 1.00 | 45 | — | 1.04 | 1.04 | 1.00 |
| Example 7 | 200 | 0.40 | 40 | 1000 | 1.21 | 1.02 | 1.19 |
| Comparative Example 4 | 200 | 0.40 | 40 | — | 1.02 | 1.02 | 1.00 |
| Example 8 | 400 | 0.55 | 50 | 800 | 1.31 | 1.07 | 1.22 |
| Comparative Example 5 | 400 | 0.55 | 50 | — | 1.07 | 1.07 | 1.00 |
| Example 9 | 100 | 0.30 | 40 | 800 | 1.20 | 0.95 | 1.26 |
| Comparative Example 6 | 100 | 0.30 | 40 | — | 0.95 | 0.95 | 1.00 |
| Example 10 | 500 | 0.30 | 60 | 800 | 1.20 | 0.95 | 1.26 |
| Example 11 | 500 | 0.80 | 60 | 500 | 1.25 | 1.12 | 1.12 |
| Comparative Example 7 | 500 | 0.80 | 60 | — | 1.12 | 1.12 | 1.00 |

TABLE 2

| | Type C micro hardness of surface | Hardness change after heat run test | Hardness rising ratio ($H_{\mu 1}/H_{\mu 0}$) | Gloss unevenness | Remarks |
|---|---|---|---|---|---|
| Example 1 | 86 | +1 | 2.7 | B | |
| Example 2 | 78 | +1 | 3.2 | A | |
| Example 3 | 77 | +1 | 3.5 | A | |
| Example 4 | 77 | 0 | 3.7 | A | |
| Example 5 | 77 | 0 | 3.8 | A | |
| Example 6 | 79 | 0 | 3.6 | A | * |
| Comparative Example 1 | 92 | +1 | 1.8 | C | |
| Comparative Example 2 | 93 | −10 | 1.1 | C | |
| Comparative Example 3 | 83 | −12 | 1.2 | B | |
| Example 7 | 75 | −1 | 4.1 | A | |
| Comparative Example 4 | 93 | −2 | 1.6 | C | |
| Example 8 | 78 | −1 | 3.1 | A | |

TABLE 2-continued

| | Type C micro hardness of surface | Hardness change after heat run test | Hardness rising ratio ($H_{\mu 1}/H_{\mu 0}$) | Gloss unevenness | Remarks |
|---|---|---|---|---|---|
| Comparative Example 5 | 92 | −2 | 1.9 | C | |
| Example 9 | 86 | +1 | 4.5 | B | |
| Comparative Example 6 | 95 | +2 | 1.7 | C | |
| Example 10 | 70 | +3 | 5.0 | A | |
| Example 11 | 84 | +1 | 2.5 | B | |
| Comparative Example 7 | 91 | +1 | 1.4 | C | |

* Fine cracks were observed in the cured silicone rubber layer.

This application claims the benefit of Japanese Patent Applications No. 2006-344271, filed Dec. 21, 2006, and No. 2007-317279, filed Dec. 7, 2007, which are hereby incorporated by reference herein in their entirety.

What is claimed is:

1. An electrophotographic fixing member comprising:

a substrate;

a cured silicone rubber layer formed on the substrate; and a fluorine resin layer adhered on the cured silicone rubber layer by an addition curing type silicone rubber adhesive, wherein the cured silicone rubber layer has the thickness in a range of 100 μm or more and 500 μm of less, wherein the cured silicone rubber layer is formed by curing a silicone rubber composition comprising vinylated polydimethylsiloxane, and the cured silicone rubber layer contains an unsaturated aliphatic group, and wherein a micro hardness $H_{\mu 0}$ and a micro hardness $H_{\mu 1}$ satisfy the following relationship:

$$2.5<H_{\mu 1}/H_{\mu 0}<5.0$$

where $H_{\mu 0}$ denotes a micro hardness of a cured rubber constituting the cured silicone rubber layer, and $H_{\mu 1}$ denotes a micro hardness of a rubber obtained by soaking the cured rubber in a methylhydrogen silicone oil for 24 hours, and then heating the cured rubber.

2. A fixing apparatus, comprising: the electrophotographic fixing member according to claim 1; and a heating unit of the electrophotographic fixing member.

3. An electrophotographic image forming apparatus, comprising: the fixing apparatus according to claim 2.

* * * * *